US006082567A

United States Patent [19]

Bietzer et al.

[11] Patent Number: 6,082,567

[45] Date of Patent: Jul. 4, 2000

[54] CAP SKIRT WITH SINGLE BEAD AND CONTAINER NECK STRUCTURE

[75] Inventors: Steven H. Bietzer, San Jose; Kurt A. Krischke, Sunnyvale; Richard E. Repp, San Jose, all of Calif.

[73] Assignee: Portola Packaging, Inc., San Jose, Calif.

[21] Appl. No.: 08/956,633

[22] Filed: Oct. 23, 1997

Related U.S. Application Data

[63] Continuation-in-part of application No. 08/853,669, May 9, 1997, which is a continuation-in-part of application No. 08/329,210, Oct. 26, 1994, Pat. No. 5,630,520, which is a continuation-in-part of application No. 07/830,133, Jan. 31, 1992, Pat. No. 5,267,661, which is a continuation-in-part of application No. 07/772,945, Oct. 8, 1991, Pat. No. 5,213,224, which is a continuation-in-part of application No. 07/565,638, Aug. 9, 1990, Pat. No. 5,190,178.

[51] Int. Cl.[7] ..... B65D 39/00

[52] U.S. Cl. ..... 215/256; 215/320; 215/354; 220/276

[58] Field of Search ..... 215/253, 254, 215/256, 320, 354; 220/270, 276

[56] References Cited

U.S. PATENT DOCUMENTS

| | | | |
|---|---|---|---|
| 3,163,308 | 12/1964 | Friedell | 215/254 |
| 3,784,038 | 1/1974 | Uhlig . | |
| 3,899,279 | 8/1975 | Hudson et al. . | |
| 3,940,004 | 2/1976 | Faulstick . | |
| 4,037,748 | 7/1977 | Stubbs . | |
| 4,187,070 | 2/1980 | Martin . | |
| 4,202,455 | 5/1980 | Faulstick . | |
| 4,296,871 | 10/1981 | Anderson . | |
| 4,298,129 | 11/1981 | Stull . | |
| 4,305,517 | 12/1981 | Dennis . | |
| 4,354,609 | 10/1982 | Hidding . | |
| 4,402,451 | 9/1983 | Woerz et al. . | |
| 4,496,066 | 1/1985 | Bullock . | |
| 4,625,876 | 12/1986 | Bullock . | |
| 4,691,834 | 9/1987 | Bullock . | |
| 4,699,285 | 10/1987 | Perne . | |
| 4,798,301 | 1/1989 | Bullock . | |
| 4,828,128 | 5/1989 | Anderson . | |
| 4,844,268 | 7/1989 | Bullock . | |
| 5,213,224 | 5/1993 | Luch . | |
| 5,224,616 | 7/1993 | Crisci . | |
| 5,284,265 | 2/1994 | Crisci . | |
| 5,373,955 | 12/1994 | Marino . | |
| 5,383,558 | 1/1995 | Wilkinson et al. . | |
| 5,456,376 | 10/1995 | Luch . | |

FOREIGN PATENT DOCUMENTS

| | | |
|---|---|---|
| 2103990 | 3/1983 | United Kingdom . |

*Primary Examiner*—Stephen Cronin
*Attorney, Agent, or Firm*—Julian Caplan; Flehr Hohbach Test Albritton & Herbert LLP

[57] ABSTRACT

A container, preferably of small capacity, such as a school milk plastic bottle, has a neck having an in-turned lip flange, a vertical surface spaced below the lip flange and an external shoulder below the vertical surface. A second external shoulder below the first-mentioned shoulder is preferably slanted upwardly-outwardly. A cap for the neck has a top and a skirt depending from the top formed with internal bead segments which snap under the first mentioned shoulder. The lower edge of the skirt fits tightly against the second shoulder to prevent the fingernails from being used to overcome the tamper-evident feature of the cap. A tear tab (preferably chevron-shaped in cross-section) depends from the skirt. An external, vertical scoreline adjoins the tab and at its upper end is adjacent a second scoreline which is formed on the interior of the top. Pulling the tab tears the skirt from the top for about 342° of its circumference. A plug hollow on the underside of the top engages the interior of the container neck. Preferably the engagement of plug and interior prevents sealing reclosure of the cap.

15 Claims, 5 Drawing Sheets

CAP SKIRT WITH SINGLE BEAD AND CONTAINER NECK STRUCTURE

CROSS REFERENCE TO RELATED APPLICATIONS AND PATENTS

This application is a continuation-in-part of application Ser. No. 08/853,669 filed May 9, 1997, now pending on TAMPER-EVIDENT CLOSURES AND CONTAINER NECK THEREFOR. application Ser. No. 08/853,669 is a continuation-in-part of U.S. application, Ser. No. 08/329,210, filed Oct. 26, 1994, now U.S. Pat. No. 5,630,520 issued May 20, 1997, which was a continuation-in-part of U.S. application, Ser. No. 07/830,133, filed Jan. 31, 1992, now U.S. Pat. No. 5,267,661, which was a continuation-in-part of U.S. application, Ser. No. 07/772,945, filed Oct. 8, 1991, now U.S. Pat. No. 5,213,224, now a continuation-in-part of U.S. application, Ser. No. 07/565,638, filed Aug. 9, 1990, now U.S. Pat. No. 5,190,178. The disclosures of the above-mentioned applications and patents are incorporated herein by reference.

BACKGROUND OF THE INVENTION

1. Field of the Invention

This invention relates to a tamper-evident closure system, generally for a container of small capacity. The closure for the container has a single bead segment which locks under a shoulder on the neck to prevent removal of the cap prior to tearing off a portion of the skirt thereof. A tear tab depends from the skirt of the cap adjacent an external scoreline which extends through the skirt from its bottom and terminates near the terminus of a circumferential internal scoreline on the underside of the top. The interrelationship of the lip flange of the container and a hollow plug on the underside of the top of the cap can be employed to prevent resealing of the cap once the user has torn the cap skirt away from the top of the cap.

2. Description of Related Art

The description of related art set forth in application Ser. No. 08/863,669 is herein incorporated by reference.

SUMMARY OF THE INVENTION

This invention comprises a cap having a top which covers the opening of a container neck and a skirt depending from the top. The skirt has at least one retainer bead formed on the interior thereof which engages a retainer formed on the exterior of the neck to retain the cap on the neck. A tab is joined to the skirt to facilitate removal of the closure from the neck. At least one frangible section is formed vicinal the tab such that when the consumer grips the tab to open the container, the frangible section is torn and interengagement between the retainers on the skirt interior and neck exterior is at least partially released.

Preferably the cap is formed with an external, substantially vertical, scoreline which extends from a point on the lower edge of the skirt adjacent the tear tab up over the outer edge of the cap top. The top is formed with an internal scoreline which extends from the vertical scoreline around the underside of the top for approximately 342°. Thus when the user pulls the tab this skirt is torn upward and then around the top so that the cap may easily be separated from the neck of the container.

An optional feature of the structure is that the closure has a central hollow plug which is engaged by a lip flange of the container in such manner that re-seating of the top of the cap on the neck is inhibited once the skirt of the closure is at least partially torn away. This, in effect, warns the user that the container is not properly re-sealed if the cap is forced onto the neck for attempted reclosure. This feature also aids re-cycling efforts since the cap cannot be reclosed on the container.

The hollow cap plug may have a substantially vertical upper outer surface merging with a downwardly-inwardly curved lower surface. The inner surface of the plug may be substantially parallel to the outer surface down almost to the lower edge of the plug or the inner surface may be substantially vertical. The former structure reduces weight while the latter makes the plug more rigid.

The closure may also be used with a neck having a sealing surface free of mold parting lines and a v-shaped stretch above the sealing surface, such that the engagement member on the interior of the skirt engages the v-shaped stretch of the neck.

The neck inner wall may have a substantially vertical cylindrical surface below the lip flange which is characterized by the absence of mold parting lines and is sealingly engaged by the cap plug. Alternatively, the lip flange may also engage the corner where the underside of the top intersects the exterior of the plug either as a supplement to the preceding seal or as a substitute therefor. In the latter case, the plug below the top contact surface may not engage the neck at all.

In a preferred embodiment the lower edge of the skirt tightly engages an external flange of the neck. The external flange slants upward-outward at about 10° from the horizontal. This structure inhibits a dishonest patron from inserting the fingernails or an instrument under the skirt to pry the cap off the neck without tearing the skirt.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 7:
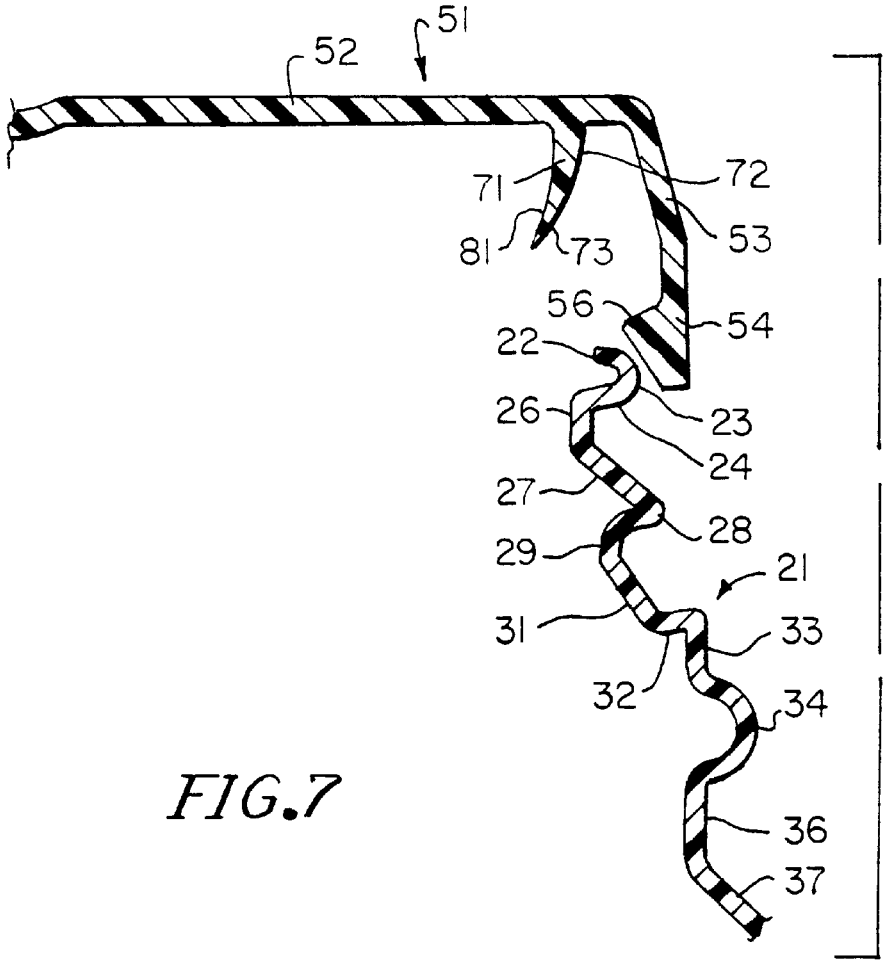
FIG. 7 is a fragmentary sectional view of a cap with a modified plug on the underside of the top and with the circumferential tear line omitted showing a neck at the commencement of the seating operation.

Directing attention first to FIG. 7 of the drawings of the present application, neck 21 of blow molded plastic commonly used in gallon milk containers has a lip flange 22 which slants upwardly inwardly. Below flange 22 is a short vertical stretch 23 which is followed proceeding downwardly of the neck by an inward bent portion 24 having at its inner terminus a vertical surface 26. Surface 26 in some forms of the present invention is the primary sealing surface with the plug of the cap. Below surface 26 the neck slants outwardly in a stretch 27 which terminates in an inward directed horizontal shoulder 28. Below shoulder 28 is a downward stretch 29 which merges with an outwardly downwardly slanted stretch 31. At the lower end of stretch 31 is a second shoulder 32 which slants upwardly at an angle of about 10°. Below shoulder 32 is a vertical stretch 33 which merges into bumper ring segments 34. Below the segments 34 is a vertical stretch 36 and the remainder of the container 37 is subject to wide variation as will be well understood in the art.

Figure 9:
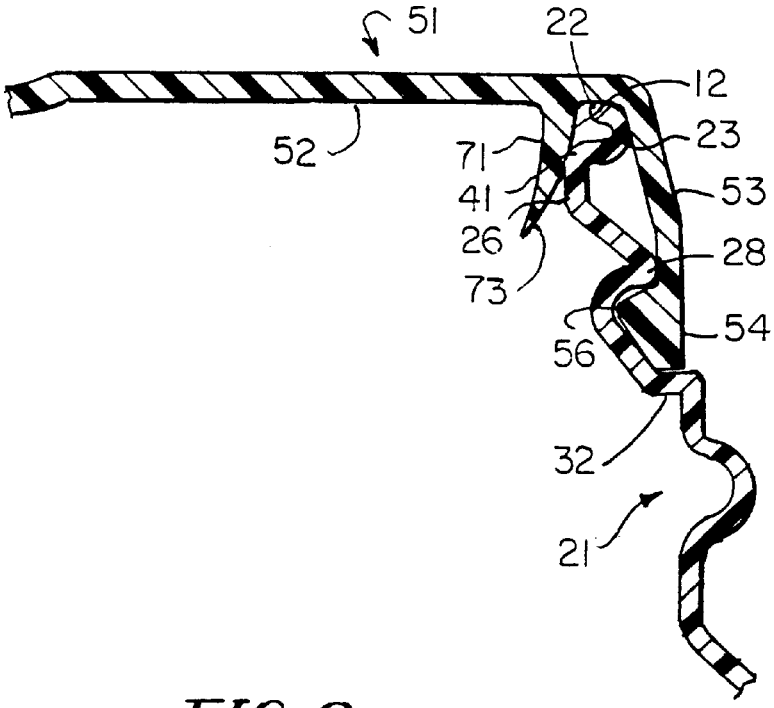
FIG. 9 is a view similar to FIG. 7 showing the cap fully seated on the neck.

FIG. 9 illustrates a primary seal 41 between surface 26 and the exterior of plug 71. The inner end of flange 22 also engages the underside of top 52.

Figure 10:
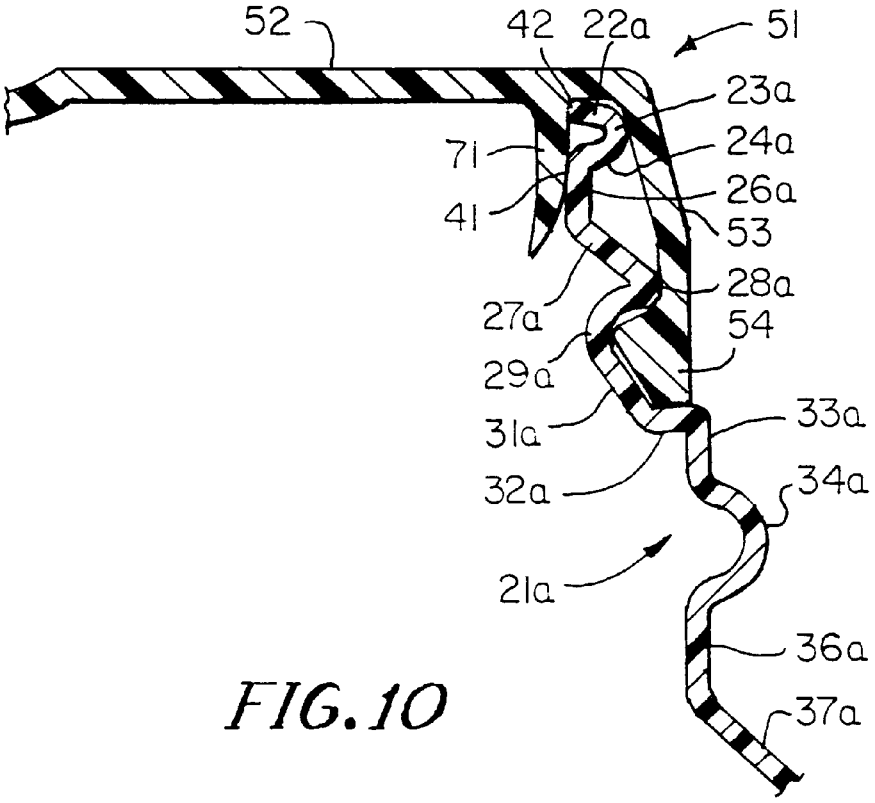
FIG. 10 is a view similar to FIG. 9 of a modified neck structure.

Directing attention to FIG. 10, the neck 21*a* has a primary seal 41 between the exterior of plug 71 and the surface 26*a* as well as a secondary sealing line 42 where the outer end of lip flange 22*a* intersects the underside of top 52 and the outside of plug 71.

Figure 11:
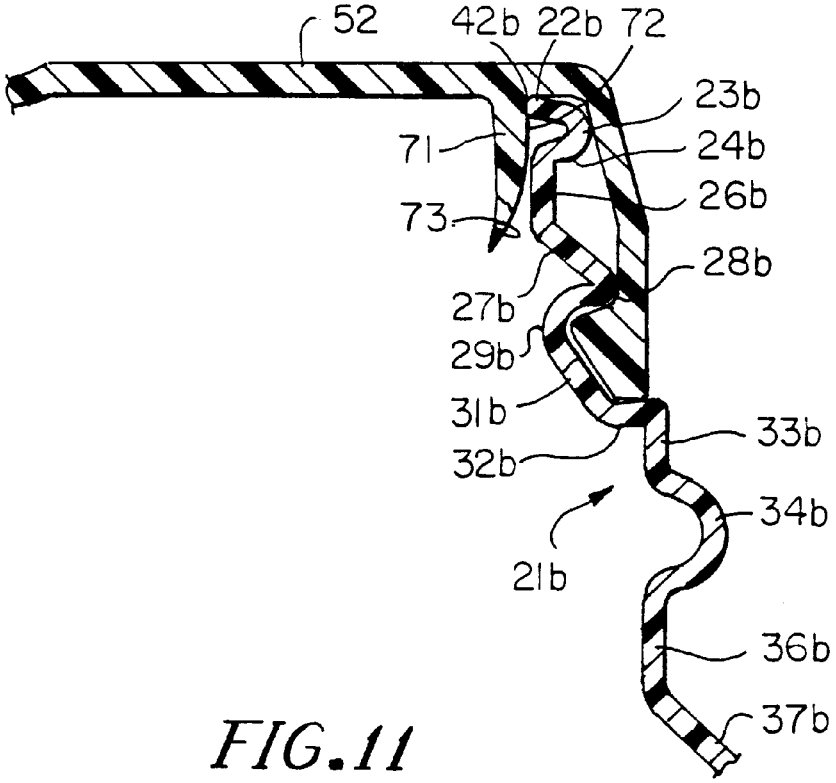
FIG. 11 is a view similar to FIG. 10 of a still further modified neck structure.

Directing attention to FIG. 11, the primary seal is between the inner edge of flange 22*b* and the corner where the underside of top 52 intersects the exterior of plug 71. It will be noted that there is no contact between the surface 26*b* and the plug 71 in FIG. 11.

The structure of the necks shown in FIGS. 10 and 11 may be finished either by a spin trim of the inner edge of the flange or by a pull-up blow pin operation, both well known in the blow molded container art.

Cap 51 is formed of a low density polyethylene material as well understood in the plastic cap art. Cap 51 has a top 52 from the periphery of which depends outward downward slanted upper skirt 53 which merges with vertical lower skirt 54. On the inside of skirt portion 54 is one or more beads or bead segments. As illustrated in the accompanying drawings, there are three bead segments. Two of the segments preferably have an arcuate length of approximately 78° while the bead segment opposite the tear tab 61 has an arcuate length of approximately 86°. The gaps between the two segments 56 adjacent the tear tab 61 is approximately 26° and the gaps between those segments and the third segment is approximately 10°.

Figure 1:
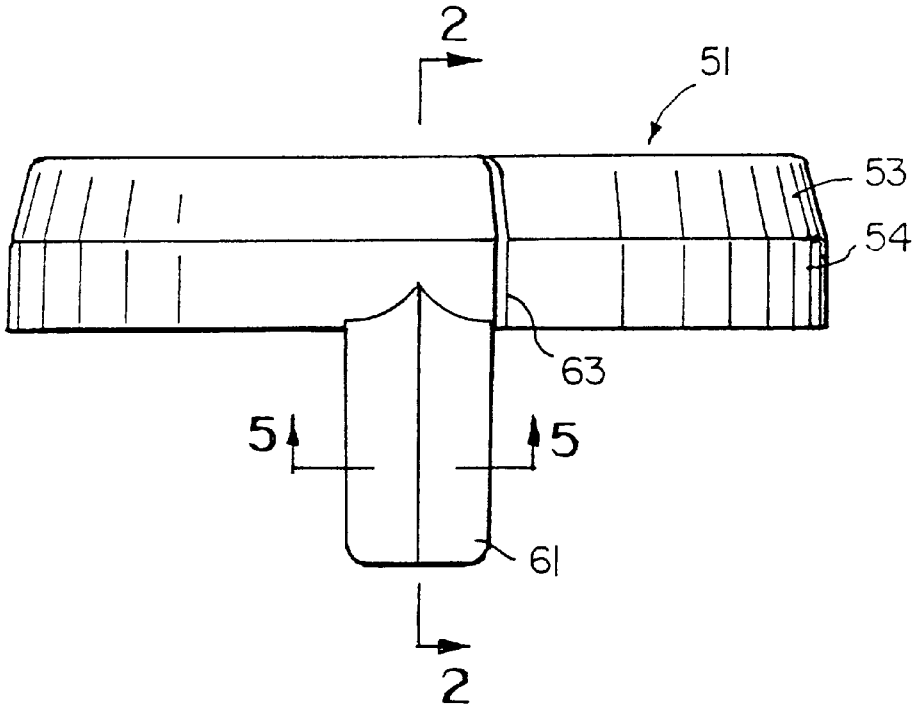
FIG. 1 is a side elevational view of a cap in accordance with the present invention.
Figure 5:
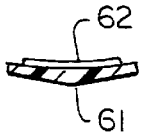
FIG. 5 is a fragmentary sectional view taken substantially along the line 5—5 of FIG. 1.
Figure 4:
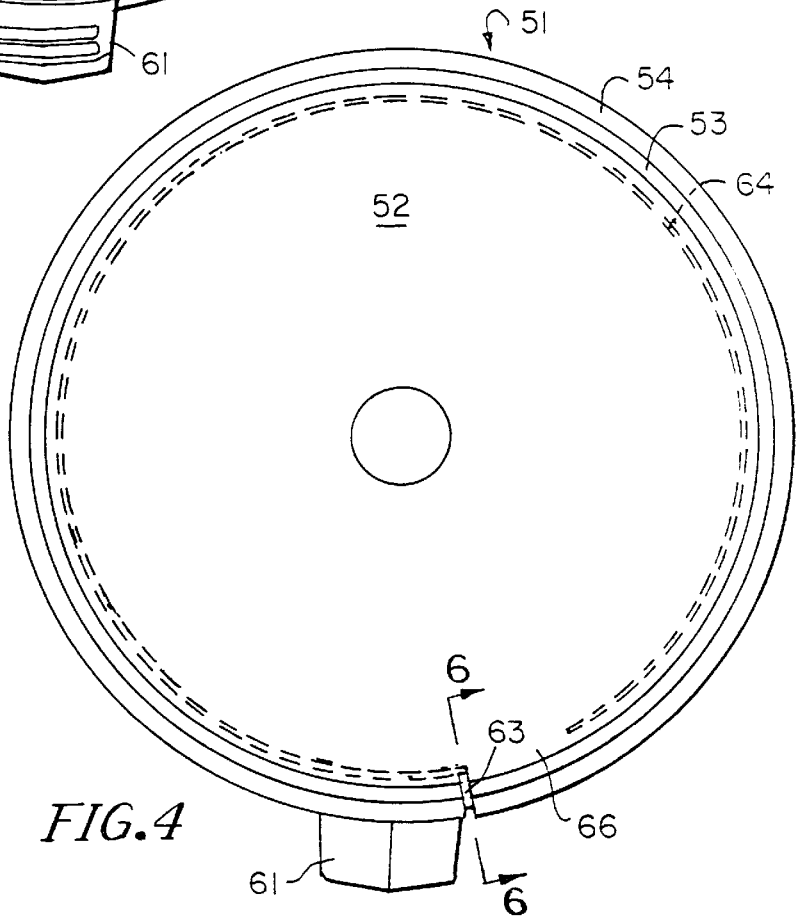
FIG. 4 is a top plan view thereof.

Depending from the lower edge of skirt portion 54 is a tear tab 61 which, as shown in FIG. 5, is formed in a chevron cross-sectional shape to afford strength and rigidity to the tab. To facilitate pulling the tab cross ribs 62 may be formed on the underside of the tab 61. As best shown in FIG. 1, adjoining the upper end of tab 61 is a substantially vertical external scoreline 63 which extends up across lower section 54 and upper section 53 and as shown in FIG. 4 extends slightly in from the periphery of top 52. Formed on the underside of top 52 is a substantially circumferential scoreline 64. As best shown in FIG. 4, the scoreline 64 does not extend entirely around the circumference but terminates with a gap 66 of approximately 18° from the beginning of the scoreline. This feature of the scoreline 54 ensures that the skirt segments 53, 54 will not be totally separated from the top 52 when the user pulls up on the tear tab 61 and around the top 52. It will be understood that scoreline 64 may have a gap 66 more or less than 18° or the gap may be entirely eliminated.

Figure 2:
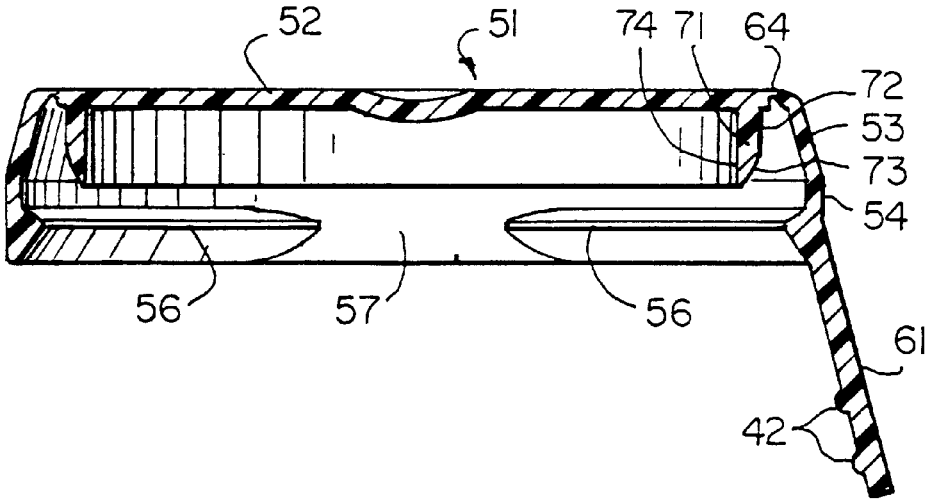
FIG. 2 is a vertical sectional view taken substantially along the line 2—2 of FIG. 1.
Figure 3:
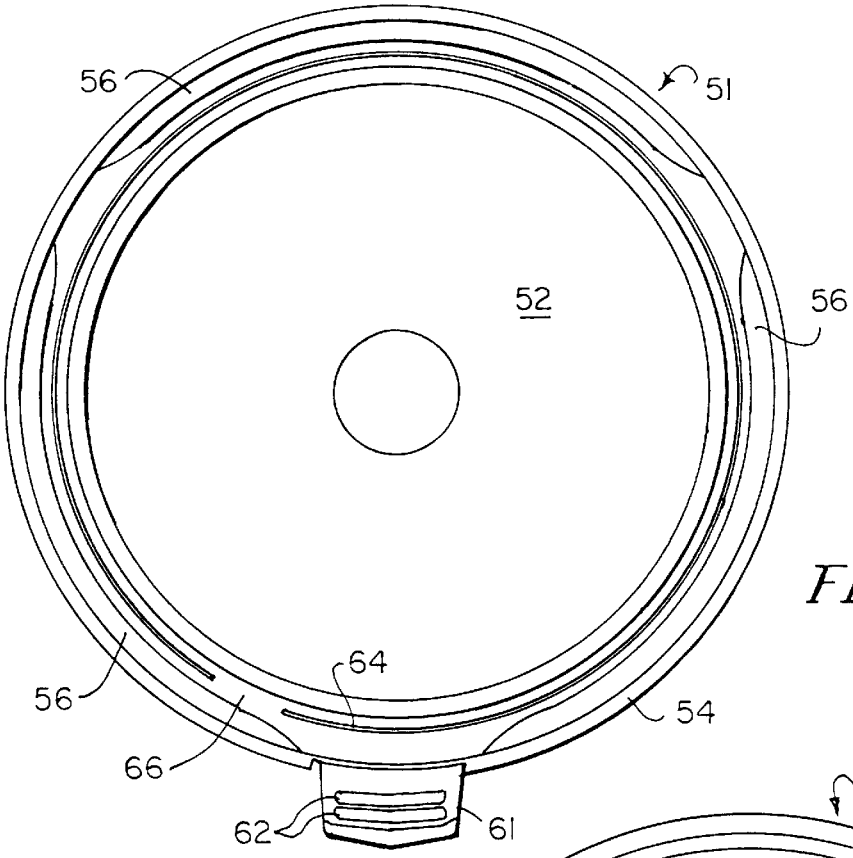
FIG. 3 is a bottom plan view thereof.
Figure 6:
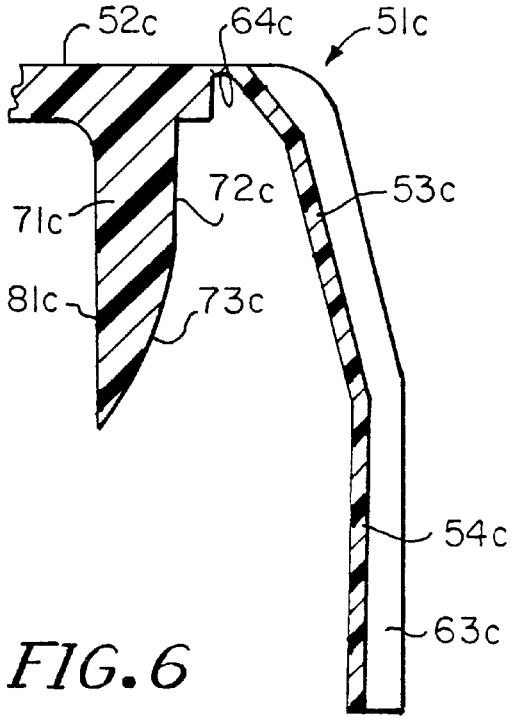
FIG. 6 is an enlarged fragmentary sectional view of a portion of FIG. 2.

Spaced inwardly from skirt 53 and scoreline 64 is a hollow plug 71. Directing attention to FIG. 2, plug 71 has a vertical external upper surface 72 merging into an inwardly curved tapered surface 73. In the form of the invention shown in FIG. 7, the inner surface 81 of plug 71 is curved to reduce the overall thickness of plug 71. In the form of the invention shown in FIG. 6, surface 81*c* is substantially vertical, rendering the plug 71*c* more rigid and slightly increasing the overall weight of the cap 51*c*.

Figure 8:
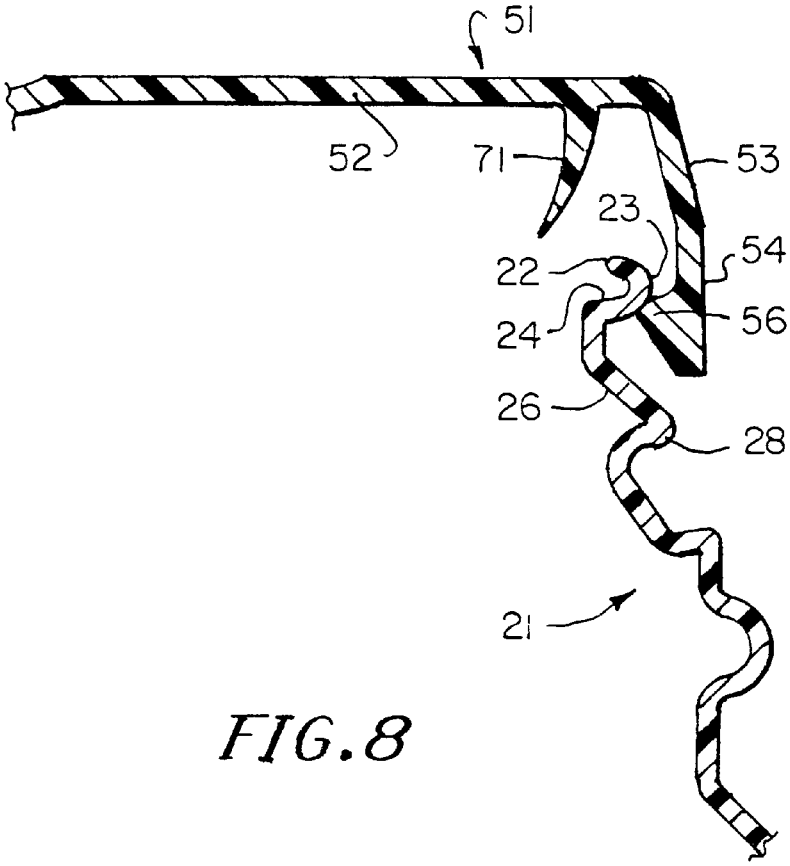
FIG. 8 is a view similar to FIG. 7 showing the next step in seating the cap on the neck.

FIG. 7 shows the condition of the neck 21 and cap 51 at the commencement of the capping operation. FIG. 8 shows the first step in the capping operation with the bead segments 56 under the inward bent stretch 24. Where the container 21 is filled with milk or other substance likely to foam, it is desirable to have the cap partially engaged as shown in FIG. 8 but not thoroughly sealed in order to permit air to dissipate. This slight retention also keeps the cap from being jarred off the neck between the time the cap is deposited on the neck and the time it is fully seated.

Directing attention to FIG. 9, at this point the cap 51 is fully seated on the neck 21. It will be noted that the exterior surface of plug 71 is in sealing engagement with surface 26 at point 41. It will further be noted that the lower edge of skirt section 54 is in tight engagement with the slanted shoulder 32 so that the fingernails cannot be used to pry the cap 51 off the neck 21 so long as the scorelines are intact.

In FIG. 10 there are two seals of the neck and cap, namely the seal at point 41 of the inner surface of plug 71 to the surface 26*a* and also the seal at point 42 of the inner edge of flange 22*a* to the underside of top 52 and the outside of plug 71.

The invention as shown in FIG. 11 discloses that the surface 26*b* is not in contact with plug 71. The sealing of the cap and neck is accomplished by the inner edge of flange 22*b* engaging the corner 42*b* of the underside of the cap top 52 and the outer edge of plug 71.

Operation

The seating of the cap on the neck may be accomplished with conventional capping devices, well known in the industry. The particular sequence shown in FIGS. 7–9 has previously been described. Sealing engagement of the neck and cap is shown in FIGS. 9–11.

To open the cap-container combination the user grips tab 61 and pulls upward, severing skirt 53–54, and then pulls around the periphery of top 52, severing along scoreline 64. The cap is then easily removed.

In the preferred embodiment, once the cap has been opened, it cannot be re-sealed on the neck. The cap top 52 is so small and light that the container flange 22 or surface 26 bearing against plug 71 forces top 52 upward. This indicates to the user that this cap is not to be used for reclosure.

The modifications of FIGS. 10, 11 and 7 in certain respects resemble those of preceding modifications and the same reference numerals followed by subscripts a, b and c, respectively, indicate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A cap comprising a top, a skirt having a bottom edge depending from said top, an internal locking bead adjacent said bottom edge, a tear tab on said skirt, a plug depending from said top positioned inward of said skirt, a first scoreline on said skirt extending upward from said bottom edge to said top, a second scoreline around the underside of said top between said skirt and said plug, said second scoreline extending only partially around the circumference of said top.

2. A cap according to claim 1 in which said first scoreline is external and said second scoreline is internal.

3. A cap according to claim 1 in which said tear tab depends from a lower edge of said skirt.

4. A cap according to claim 3 in which said tab is chevron-shaped in cross-section.

5. A cap comprising a top, a skirt having a bottom edge depending from said top, an internal locking bead adjacent said bottom edge, a tear tab on said skirt, a hollow plug depending from said top positioned inward of said skirt, a first scoreline on said skirt extending upward from said bottom edge to said top, and a second scoreline around the underside of said top between said skirt and said plug, said plug in radial cross-section having a straight outer upper portion and an inwardly-downwardly slanted outer lower portion, the lower portion of said plug being of lesser diameter than the interior of the plug at its juncture with the underside of the top.

6. A cap according to claim 5 in which in radial cross-section said plug has a vertical interior.

7. A cap according to claim 5 in which in radial cross-section said plug interior is concave.

8. In combination, a cap comprising a top, a skirt having a bottom edge depending from said top, an internal locking bead adjacent said bottom edge, a plug depending from said top positioned inward of said skirt, a first scoreline on said skirt extending upward from said bottom edge to said top, a second scoreline around the underside of said top between said skirt and said plug, said second scoreline extending only partially around the circumference of said top and a cap neck having a lip flange, and, in sequential order below said lip flange, an inward stretch, a vertical stretch, a first downward-outward slanted stretch, an external first shoulder positioned to engage under said locking bead, a second downward-outward stretch and an external second shoulder.

9. The combination of claim 8 in which said cap has a plug depending from said top positioned inward of said skirt, said neck sealingly engaging said cap only at the intersection of the underside of said top and the exterior of said plug.

10. The combination of claim 8 in which said second shoulder slants upward-outward, said cap skirt bottom edge engaging said second shoulder.

11. The combination of claim 10 in which said second shoulder slants at an angle of about 10° to the horizontal.

12. The combination of claim 8 which said cap has a plug depending from said top positioned inward of said skirt, said vertical stretch sealingly engaging said plug.

13. The combination of claim 12 in which said lip flange sealingly engages an underside of said top.

14. The combination of claim 12 in which said lip flange sealingly engages the intersection of the underside of said top and the exterior of said plug.

15. A cap comprising a top, a skirt having a bottom edge depending from said top, an internal locking bead adjacent said bottom edge, a tear tab on said skirt, a plug depending from said top positioned inward of said skirt, a first scoreline on said skirt extending upward from said bottom edge to said top, a second scoreline around the underside of said top between said skirt and said plug, said second scoreline extending around the circumference of said top less than 360°.

* * * * *